US008714955B2

(12) United States Patent
Vincent et al.

(10) Patent No.: US 8,714,955 B2
(45) Date of Patent: May 6, 2014

(54) CONFIGURATION FOR MOULDING A BLEND MADE OF METAL POWDER AROUND A CERAMIC CORE

(75) Inventors: Denis Vincent, Saint-Martin-le-Vinoux (FR); Mathilde Carriquiry, Brezins (FR); Simmon Maldera, Barberaz (FR)

(73) Assignee: Commissariat à l'énergie atomique et aux énergies alternatives, Paris (FR)

( * ) Notice: Subject to any disclaimer, the term of this patent is extended or adjusted under 35 U.S.C. 154(b) by 0 days.

(21) Appl. No.: 13/996,705

(22) PCT Filed: Dec. 19, 2011

(86) PCT No.: PCT/EP2011/073214

§ 371 (c)(1),
(2), (4) Date: Sep. 11, 2013

(87) PCT Pub. No.: WO2012/084803

PCT Pub. Date: Jun. 28, 2012

(65) Prior Publication Data

US 2013/0344185 A1 Dec. 26, 2013

(30) Foreign Application Priority Data

Dec. 21, 2010 (FR) ..... 10 60896

(51) Int. Cl.

| | |
|---|---|
| ***B30B 11/00*** | (2006.01) |
| ***B22F 3/03*** | (2006.01) |
| ***B30B 11/04*** | (2006.01) |
| *B30B 11/02* | (2006.01) |
| *B30B 11/06* | (2006.01) |

(52) U.S. Cl.
CPC . *B22F 3/03* (2013.01); *B30B 11/02* (2013.01); *B30B 11/04* (2013.01); *B30B 11/06* (2013.01)
USPC ..... 425/78; 419/61

(58) Field of Classification Search
CPC ..... B30B 11/02; B30B 11/04; B30B 11/06; B22F 3/03
USPC ..... 425/78; 419/61
See application file for complete search history.

(56) References Cited

U.S. PATENT DOCUMENTS 3,200,442 A * 8/1965 Haller ..... 425/78
3,682,742 A * 8/1972 Wheeler ..... 425/128

(Continued)

FOREIGN PATENT DOCUMENTS

EP 0 242 294 10/1987
EP 0 538 073 4/1993

(Continued)

OTHER PUBLICATIONS

International Search Report Issued Mar. 23, 2012 in PCT/EP11/073214 filed Dec. 19, 2011.

*Primary Examiner* — Jacob Thomas Minskey
(74) *Attorney, Agent, or Firm* — Oblon, Spivak, McClelland, Maier & Neustadt, L.L.P.

(57) ABSTRACT

A configuration for molding of a blend of metal powder around a core, which includes a mold delimiting a cavity, and which includes an elastically deformable portion on which the core is pressed, so as to adapt dimensions of the cavity to dimensions of the core. The elastically deformable portion includes an elastically deformable metal blade on one face of which the core is pressed directly.

9 Claims, 3 Drawing Sheets

(56) References Cited

U.S. PATENT DOCUMENTS

| | | | | |
|---|---|---|---|---|
| 5,258,155 | A | 11/1993 | Sekido et al. | |
| 5,393,484 | A | 2/1995 | Seyama et al. | |
| 5,672,363 | A * | 9/1997 | Sagawa et al. | 425/3 |
| 2003/0227750 | A1 * | 12/2003 | Glovatsky et al. | 361/699 |
| 2004/0247728 | A1 * | 12/2004 | Ozeki | 425/354 |
| 2010/0028704 | A1 * | 2/2010 | Austin | 428/551 |

FOREIGN PATENT DOCUMENTS

| | | |
|---|---|---|
| FR | 2 485 987 | 1/1982 |
| FR | 2 707 205 | 1/1995 |

* cited by examiner

CONFIGURATION FOR MOULDING A BLEND MADE OF METAL POWDER AROUND A CERAMIC CORE

TECHNICAL FIELD

The invention proposes a configuration to form a part consisting of two portions comprising a core and an external body made of a polymer material consisting of metal or ceramic powder partly covering the ceramic core.

The invention proposes a mould enabling the injection stresses to be resisted, whilst not damaging the core, which is fragile.

STATE OF THE PRIOR ART

Powder injection moulding (PIM) enables ceramic or metal components of complex shapes to be produced using equipment used in the field of plastic moulding.

Such a powder injection moulding method involves a first step which involves producing a blend called a "feedstock", which consists of a blend of organic matter forming a polymer binder, and a ceramic or metal inorganic powder. The proportion of inorganic powder in the feedstock is between 40% and 70% by volume.

A second step of the powder injection moulding method consists in producing the part or parts by injecting the feedstock, using conventional plastics processing equipment.

After this, in a third step, the organic binder is eliminated and the part obtained is then sintered.

Production of a part made of two separate materials using such a moulding method consists in producing a first portion, or core, made of a first material, for example made of ceramic, and then in forming the external body of this part by injection moulding of the feedstock containing the powder.

Depending on the design of the component it is sometimes necessary that the faces of the core are not covered by the feedstock.

To this end, it is customary to produce the mould in such a way that each of the faces which must remain uncovered by the external body is in direct contact with a portion of the mould.

Thus, to prevent the feedstock infiltrating between the mould and each uncovered face of the core, a certain pressure is applied between the core and the mould in order to maintain satisfactory contact between the respective faces of the core and the mould.

The ceramic core is manufactured with certain dimensional tolerances. This means that caution must be taken not to cause the core to break when the mould is closed, since the pressure applied on the core could cause it to break.

Document no FR 2.485.987 describes a mould made of an elastomer material.

Such a mould enables allowance to be made for the dimensional variations of the core without any risk of breaking it.

However, due to the substantial pressure used when the feedstock is injected, the elastomer material is deformed and the walls of the mould and the ceramic core are then no longer in contact, such that a portion of the feedstock may infiltrate between the core and the mould, and then cover a face which must remain uncovered, or again form burrs.

The powder contained in the feedstock is also particularly abrasive, which may damage the walls of the mould, and therefore cause defects in the component obtained.

Document FR.2.707.205 describes a mould of which only a portion covering the core is made of a synthetic material.

Although such a solution also enables breakage to be prevented by adapting the dimensions of the cavity to the dimensional variations of the core, use of a synthetic material makes this part sensitive to the injection pressure and to abrasion.

One aim of the invention is to propose a configuration for the feedstock injection moulding around a core enabling allowance to be made for the core's dimensional variations, and which is also able to resist the injection pressure and the abrasion of the powder constituting the feedstock.

DESCRIPTION OF THE INVENTION

The invention relates to a configuration for the overmoulding by injection of a blend made of metal and/or inorganic powder around a core including an upper horizontal face and a lower horizontal face, which includes a mould delimiting a cavity in which the core is received, such that the upper face of the core is pressed against a facing upper face of the cavity, and the lower face of the core is pressed against a facing lower face of the cavity, and which includes an elastically deformable portion on which at least one of the upper or lower faces of the core is pressed, characterised in that the elastically deformable portion includes an elastically deformable metal blade on at least one face of which the core is pressed directly.

Production of the elastically deformable portion from a metal plate enables this deformable portion to resist the abrasion and the pressure resulting from the injection of the feedstock, whilst adapting the dimensions of the cavity to the dimensions of the ceramic core.

The elastically deformable portion preferably includes a plastic plate which is compressed between the metal blade and a rigid portion of the mould.

The mould preferably includes a hollow recess open towards the cavity, which receives the elastically deformable portion in such a way that the metal blade is located at some distance from the bottom of the hollow recess.

The plastic plate is preferably positioned between the metal blade and the bottom of the hollow recess.

The metal blade is preferably positioned at the opening of the hollow recess.

The metal blade is preferably made of spring steel.

The plastic plate is preferably compressed between the metal blade and the bottom of the hollow recess.

The plastic plate is preferably made of polytetrafluoroethylene (PTFE).

The plastic plate is preferably made of 15% graphite filled polytetrafluoroethylene (PTFE).

The elastically deformable portion is preferably installed in a non-permanent manner in the hollow recess.

BRIEF DESCRIPTION OF THE ILLUSTRATIONS

Other characteristics and advantages of the invention will come to light on reading the detailed description which follows, for the understanding of which reference will be made to the appended illustrations, in which.

DETAILED DESCRIPTION OF PARTICULAR EMBODIMENTS

In the following description identical, similar or comparable elements will be designated by the same reference figures.

Figure 1:
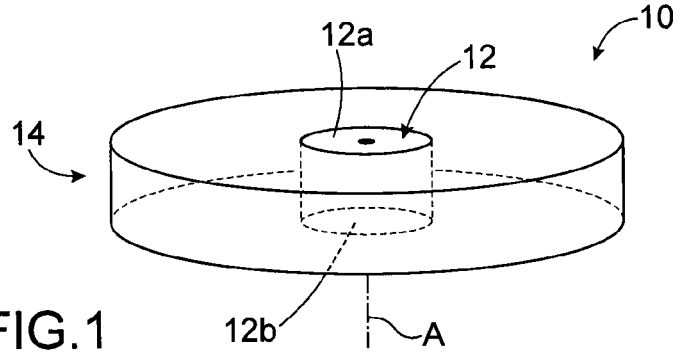
FIG. 1 is a schematic perspective representation of a part produced with a configuration according to the invention.

FIG. 1 shows a representation of a part 10 produced as two portions, which comprises a ceramic central core 12 and an outer metal body 14.

Outer body 14 is made from a blend of a powder of inorganic material, i.e. for example a metal or ceramic powder, combined with an organic binder. In what follows the common name "feedstock" will be used to designate this blend.

For example, the feedstock is made from a metal powder consisting of spherical balls less than 45 μm in diameter, and the binder is a blend made of polyéthylène or paraffin and stearic acid.

Outer body 14 is made by overmoulding the feedstock around central core 12; the binder of the feedstock is then eliminated and part 10 is then sintered.

Core 12 in this case has a generally cylindrical shape with a main vertical axis A. It is produced in conventional fashion or using a powder injection moulding method. Dimensional variations, notably relating to its axial length, are consequently envisaged.

Outer body 14 is made by overmoulding the feedstock around core 12 such that the horizontal upper end face 12*a* and the horizontal lower end face 12*b* of core 12 are not covered by the feedstock.

Figure 2:
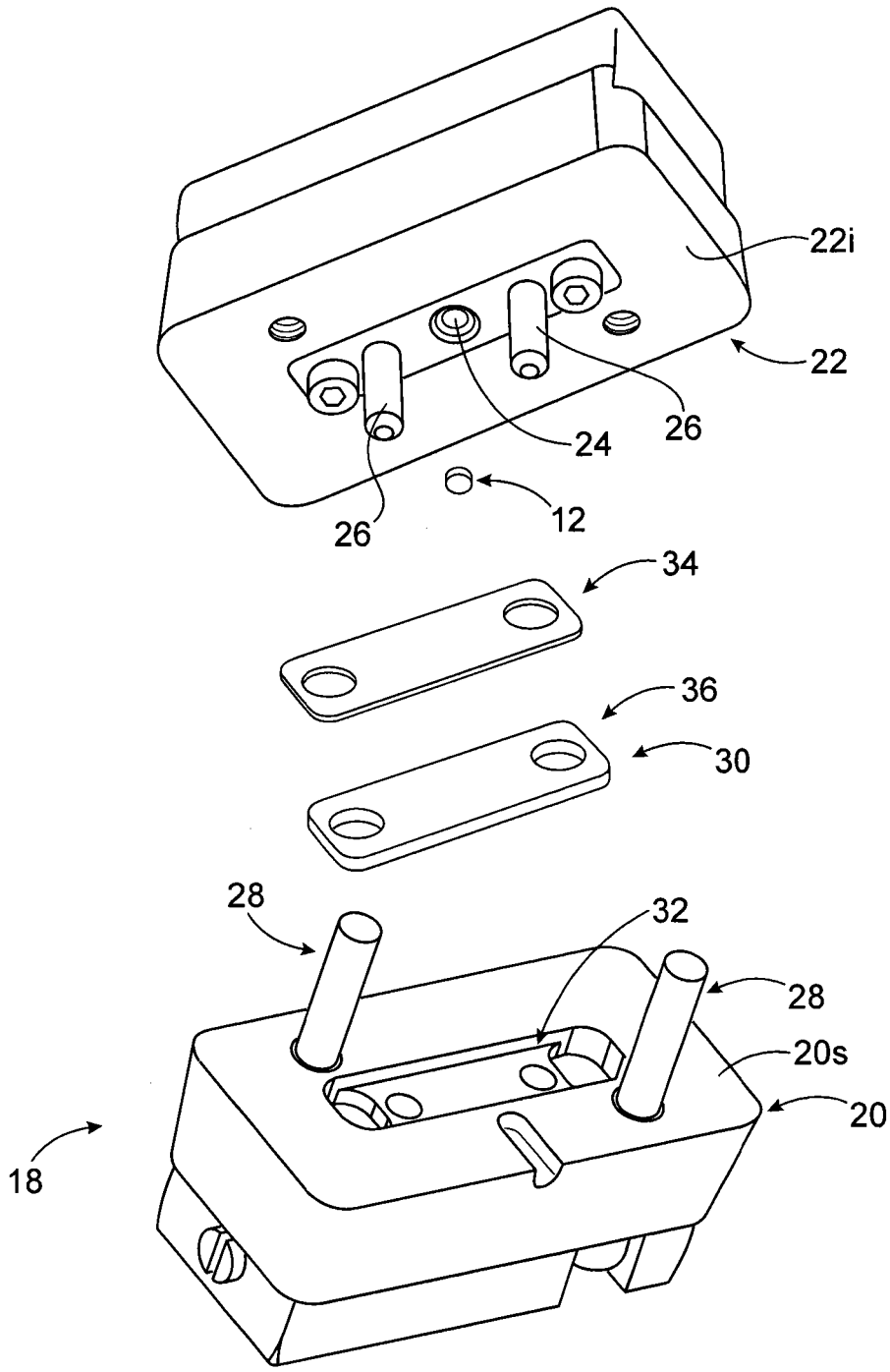
FIG. 2 is a schematic perspective representation of an exploded diagram of a configuration according to the invention.

FIG. 2 and following show representations of a configuration to produce outer body 14 of part 10 by overmoulding the feedstock around core 12.

This configuration is intended to be installed in a metal carcass of a conventional injection press.

The configuration includes mainly a mould 18, which may also consist of a mould portion or a frame, which consists of a fixed lower first portion 20 and a moving upper portion 22.

Fixed portion 20 and moving portion 22 delimit a cavity 24 in which core 12 is positioned, and in which the feedstock is intended to be injected to form outer body 14 of part 10.

Fixed portion 20 and moving portion 22 of mould 18 also include catches 26 to position them relative to one another, and means 28, in this case consisting of a screw system, to exert a force to clamp both portions 20, 22 of mould 18 against one another, to resist the injection pressure.

The dimensions of both portions 20, 22 of the mould are relatively large compared to the dimensions of cavity 24 and of part 10 to be produced, since the deformation of both parts 20, 22 of mould 18 must be as small as possible when the feedstock is injected.

Figure 3:
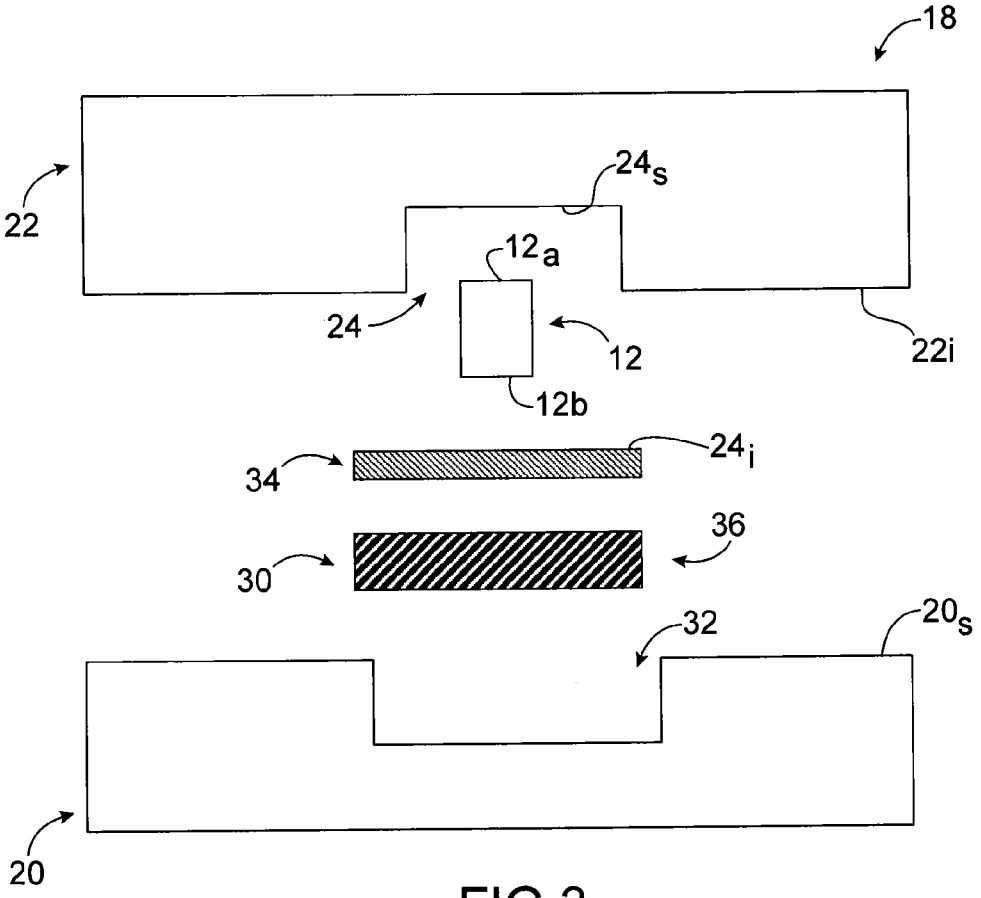
FIG. 3 is an exploded view seen as an axial section of the configuration represented in FIG. 1.

As has been represented schematically in FIG. 3, core 12 is inserted in cavity 24 before mould 18 is closed.

When core 12 is in position in cavity 24, upper face 12*a* of core 12 is pressed against an upper face 24*s* of cavity 24, and lower face 12*b* of core 12 is pressed against a lower face 24*i* of cavity 24.

Due to the dimensional tolerances for core 12, the core's axial length can be more or less than a nominal dimension.

The distance between upper face 24*s* and lower face 24*i* of cavity 24, when mould 18 is closed, is defined such that whatever the axial length of core 12 upper face 12*a* and lower face 12*b* of core 12 are always pressed against upper face 24*s* and lower face 24*i* of cavity 24.

This means that this distance between upper face 24*s* and lower face 24*i* of cavity 24 is always less than or equal to the axial length of core 12. This means that it can be guaranteed that the feedstock cannot cover upper face 12*a* and lower face 12*b* of core 12.

Figure 4:
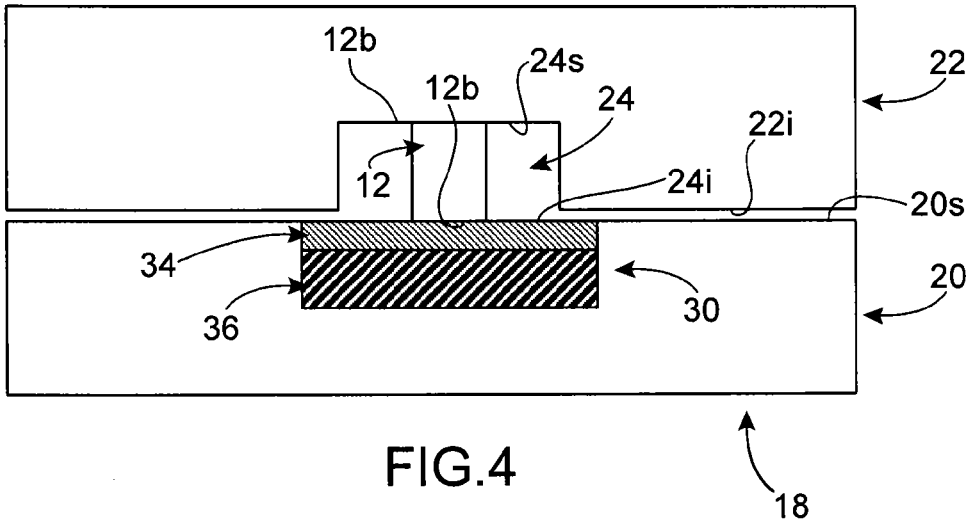
FIG. 4 is a section similar to that of FIG. 3, showing the dimensional differences between the cavity of the mould and the ceramic core.

As can be seen in FIG. 4, since this distance is less than the real length of core 12, when mould 18 is closed upper face 12*a* and lower face 12*b* of core 12 are respectively pressed against upper face 24*s* and lower face 24*i* of cavity 24 before lower portion 20 and upper portion 22 of mould 18 are pressed against one another.

Core 12 is made of ceramic and may break if the clamping force of portions 20, 22 of mould 18 is applied to core 12.

To prevent breaking of core 12, mould 18 includes an elastically deformable portion 30 which can be deformed when mould 18 is closed to compensate for the difference between the length of core 12 and the distance between upper face 24*s* and lower face 24*i* of cavity 24.

In this case deformable portion 30 is positioned in a hollow recess 32 formed in fixed portion 20 of mould 18 such that an upper face of deformable portion 30 delimits at least partially lower face 24*i* of cavity 24.

In this case, the upper face of deformable portion 30 is flush with upper face 20*s* of fixed portion 20 of mould 18.

The shape of hollow recess 32 is complementary to the shape of deformable portion 30.

Figure 5:
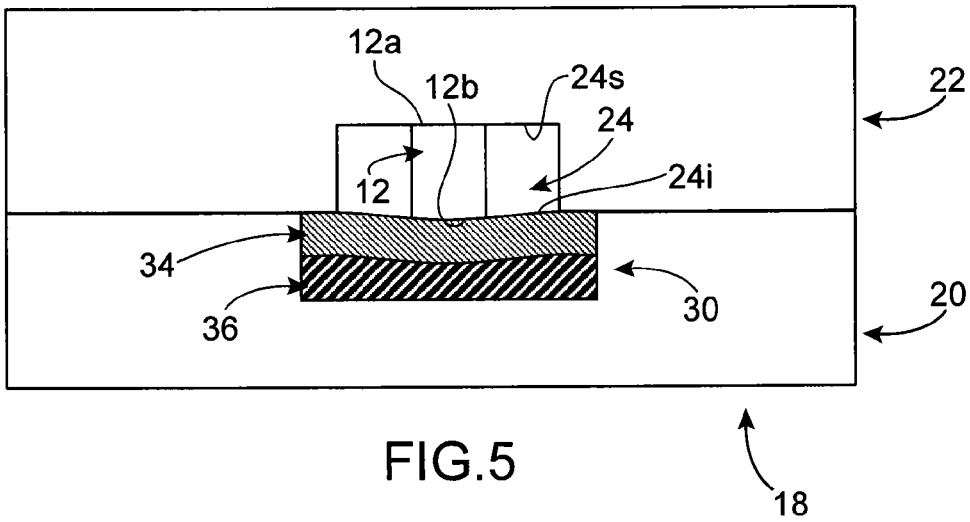
FIG. 5 is a view similar to that of FIGS. 3 and 4, in which the mould is closed and the deformable part of the mould is deformed.

As can be seen in FIG. 5, when mould 12 is closed, core 12 is pressed against deformable portion 30 which is deformed elastically, such that core 12 is subject to a limited pressing force.

During the overmoulding operation to form outer body 14, i.e. when the feedstock is injected, the axial compression force of core 12 between upper portion 22 of the mould and deformable portion 30, resulting from the elastic deformation of deformable portion 30, is sufficiently great to prevent the feedstock infiltrating between upper face 12*a* and lower face 12*b* of core 12 and facing faces 24*s*, 24*i* of cavity 24, respectively, and between lower face 22*i* of upper portion 22 of mould 18 and upper face 24*s* of deformable portion 30.

Deformable portion 30 includes a metal blade 34 which is elastically deformable, an upper face of which forms at least partly lower face 24*i* of cavity 24.

The upper face of metal blade 34 preferably forms completely lower face 24*i* of cavity 24.

A lower part of core 12 is directly pressed against the horizontal upper face of blade 34, and it causes a downward elastic deformation of the blade when mould 18 is closed, to compensate for the difference of values between the top of core 12 and the distance between faces 24*s*, 24*i* facing cavity 24.

As a counterpart to this elastic deformation, blade 34 produces on core 12 an elastic force equal to its deformation.

Blade 34 is made of a spring steel of the type known by the name X10. The hardness of such a metal is particularly advantageous in the present case of injection of the blend consisting of metal powder. Indeed, the powder forming the feedstock is particularly abrasive, and such a metal constituting blade 34 is sufficiently resistant to abrasion for blade 34 not to be damaged when the feedstock is injected.

This metal constituting blade 34 therefore enables the deformations resulting from the injection pressure to be limited.

The deformable portion also includes a plate made of plastic 36 which is compressed between metal blade 34 and the bottom of hollow recess 32 receiving deformable portion 30.

Plastic plate 36 functions as a dampener of the deformation of blade 34; it is elastically deformed by compression when mould 18 is closed, and produces an elastic force on metal plate 34, which is transmitted to core 12.

The elasticity of plastic plate 36 is determined such that, whatever the dimensions of core 12, the elastic force produced by plastic plate 36, combined with the force produced by blade 34 after mould 18 is closed, is sufficiently great to prevent any infiltration of feedstock on upper face 12*a* and lower face 12*b* of core 12, such that this elastic force is less than a force which might cause core 12 to break by compression.

Plastic plate 36 therefore enables the extent of the deformation of blade 34 to be limited to a zone centered on the contact surface of core 12 on the upper face of blade 34. Then, so formed peripheral body 14 will therefore have a small additional thickness at lower end 12*b* of core 12.

According to one unrepresented variant embodiment, deformable portion 30 of the mould consists solely of a metal blade 34.

An empty space is maintained between blade 34 and the bottom of hollow recess 32, for example by means of wedges, to enable the lower part of blade 34 to be deformed elastically in hollow recess 32.

The dimensions of blade 34 are then determined so as to produce an elastic force on core 12 which prevents the feedstock covering the faces of core 12, and which does not cause core 12 to break.

Despite the fact that blade 34 is resistant to the abrasion of the metal powder it may be damaged as mould 18 is used.

To this end blade 34, and possibly plastic plate 36, can be removed from hollow recess 32 and be replaced by a new blade 34, or a new plastic plate 36, respectively.

To facilitate this exchange, blade 34 and plastic plate 36 are not attached in hollow recess 32, and they are held in position firstly by moving portion 22 of the mould, and secondly by the feedstock's injection pressure.

As a non-restrictive example, blade 34 is made of X10 CrNi18-8 spring steel, its HV hardness is between 170 and 250, its Young's modulus is 195 GPA and its traction resistance limit (Rm) is 690 to 900 MPa.

Plastic plate 36 is thus, according to a first example made of unfilled polytetrafluoroethylene (PTFE), its Shore D hardness is 50 to 65, its Rockwell hardness is 25, its Young's modulus is 300 to 800 MPa, its traction resistance: 10 to 40 MPa, and its ultimate elongation is between 100 and 400%.

According to a second example, plastic plate 36 is made of 15% graphite filled PTFE. Its Shore D hardness is higher than 55, its density is 2.14 to 2.19 g/cm3 and its ultimate elongation is greater than 200%.

The invention claimed is:

1. A configuration for overmolding by injection of a blend of a metal and/or inorganic powder around a core including an upper horizontal face and a lower horizontal face, comprising:

a mold delimiting a cavity in which the core is received, such that an upper face of the core is pressed against a facing upper face of the cavity and a lower face of the core is pressed against a facing lower face of the cavity, and which includes an elastically deformable portion on which at least one of the upper or lower faces of the core is pressed, wherein the elastically deformable portion includes an elastically deformable metal blade on at least one face of which the core is pressed directly, wherein the mold includes a hollow recess open towards the cavity, which receives the elastically deformable portion such that the metal blade is located at a distance from a bottom of the hollow recess.

2. A configuration according to claim 1, wherein the elastically deformable portion includes a plastic plate that is compressed between the metal blade and a rigid portion of the mold.

3. A configuration according to claim 2, wherein the plastic plate is positioned between the metal blade and the bottom of the hollow recess.

4. A configuration according to claim 3, wherein the metal blade is positioned at an opening of hollow recess.

5. A configuration according to claim 2, wherein the plastic plate is compressed between the metal blade and the bottom of the hollow recess.

6. A configuration according to claim 1, wherein the metal blade is made of spring steel.

7. A configuration according to claim 2, wherein the plastic plate is made of polytetrafluoroethylene (PTFE).

8. A configuration according to claim 7, wherein the plastic plate is made of 15% graphite filled polytetrafluoroethylene (PTFE).

9. A configuration according to claim 1, wherein the elastically deformable portion is installed in a non-permanent manner in the hollow recess.

* * * * *